US006071161A

United States Patent [19]

Weissbuch

[11] Patent Number: 6,071,161

[45] Date of Patent: Jun. 6, 2000

[54] AQUATIC EXERCISE DEVICE WITH BUOYANT ELEMENTS

[76] Inventor: Sanford S. Weissbuch, 2276 S. Beverly Glen Blvd., #202, Los Angeles, Calif. 90064

[21] Appl. No.: 09/119,930

[22] Filed: Jul. 21, 1998

Related U.S. Application Data

[60] Provisional application No. 60/057,859, Sep. 2, 1997.

[51] Int. Cl.[7] ..... B63C 9/08

[52] U.S. Cl. ..... 441/106; 441/108; 441/114; 441/119

[58] Field of Search ..... 441/106, 108, 441/113, 114, 117, 119, 122

[56] References Cited

U.S. PATENT DOCUMENTS 3,416,172 12/1968 Gerling ..... 441/108
5,000,710 3/1991 Bedortha .
5,348,505 9/1994 Rothhammer .
5,393,230 2/1995 Vizintin et al. ..... 441/106
5,472,391 12/1995 Weissbuch ..... 441/106
5,588,891 12/1996 Bardot ..... 441/117

*Primary Examiner*—Stephen Avila
*Attorney, Agent, or Firm*—Merchant & Gould P.C.

[57] ABSTRACT

An aquatic exercise device includes at least two specially shaped buoyant elements to be worn around the midsection of a human. The buoyant elements are affixed to a band or belt for surrounding the mid portion of the human and for securing at least two buoyant elements to the band. The buoyant elements can be located in multiple relationships on the band about the body. The exercise device can take on different shapes about the body and buoyancy characteristics in order to meet the requisite conditions, needs or desires of the user.

4 Claims, 3 Drawing Sheets

AQUATIC EXERCISE DEVICE WITH BUOYANT ELEMENTS

RELATED APPLICATION

This application relates to U.S. Provisional Patent Application No. 60/057,859, filed Sep. 2, 1997, entitled "Aquatic Exercise Device with Buoyant Elements". The contents of that application are incorporated by reference herein, and priority is claimed from that application.

BACKGROUND OF THE INVENTION

An aquatic exercise device which is versatile and can be used in the water by a person who wishes to stay partially afloat and upright is highly desirable.

This invention involves an aquatic exercise device. In particular, the invention is concerned with a device for people that do upright exercise in the water such as water running.

It is currently unknown to have a device which can be strapped about the body in a variety of manners so as to fit to different body shapes and which can adjust buoyancy characteristics in the most ideal way for a particular user.

This invention relates to an aquatic device with buoyant elements which was described in the present applicant's U.S. Pat. No. 5,472,391. The contents of that disclosure are incorporated by reference herein.

SUMMARY OF THE INVENTION

This invention provides for an aquatic exercise device which minimizes the above problem.

According to the invention, there is provided a flotation device with at least two specially shaped buoyant elements to be worn around the midsection of a human. Affixed to the buoyant elements is a band or belt for surrounding the mid portion of the human and for securing at least two buoyant elements to the band or belt. The buoyant elements can be located in multiple relationships on the band or belt about the body. In this fashion, the exercise device can take on different shapes about the body and buoyancy characteristics in order to meet the requisite conditions of the user. The flotation device is used to increase the buoyancy of a human.

In one form of the invention each of the buoyant elements has a broader section and a narrower section. Each shape is like the silhouette of a mushroom or a T. In one arrangement, the broad sections of the buoyant elements are in adjacency to each other, and the narrower sections are more removed from each other.

In another form of the invention as used, the narrower sections are in adjacency to each other and the broader sections are more removed from each other.

In preferred uses of the invention, each of the buoyant elements as connected to the band or belt are located around the side portions of the respective waist of the user rather than the back or forward portions of the user.

Each buoyant element may be made of two components which are adhered together with one or more slots or passageways running through the components so that the belt or band can pass through the components. There can be one or more different slots or passageways through the components for the band or belt to pass in different directions through the components. Alternatively, there can be apertures in different locations on each buoyant element so that a band or belt can be affixed in different directions relative to each buoyant element.

The invention is now further described with reference to the accompanying drawings.

DETAILED DESCRIPTION OF THE PREFERRED EMBODIMENT

Figure 1:
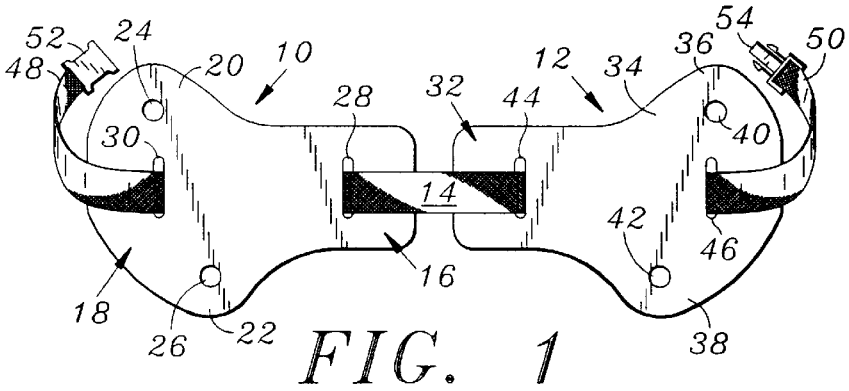
FIG. 1 is a perspective view showing two asymmetrically shaped buoyant elements attached to a band or belt in one relationship.

The aquatic exercise device includes a pair of buoyant elements which are held together by a band or strap 14. The buoyant element 10 has a narrow portion 16 and a broader portion 18, and are substantially mushroom shaped. The broader portion 18 is effectively formed by two lobes 20 and 22, which extend in a relatively transverse position from a line defined by the band or belt 14 going about the waist. Lobe 20 is further removed from the narrower portion 16 than is lobe 22. The lobes form the head of the mushroom and the narrower portion 16 forms the stem of the mushroom. In lobe 20 there is an aperture 24, and in lobe 22 there is an aperture 26 through the buoyant element 10. This permits a user to manipulate the buoyant element 10, and thereby move the buoyant element 10 upwardly or downwardly on the body to facilitate comfortable use. There is also a slotted aperture 28 and a mating aperture 30 provided at a spaced distance in the buoyant element 10 at which is threaded the band or belt 14. This threading secures the buoyant element 10 to the band or belt 14.

Buoyant element 12 has a similar configuration with a narrower section 32 and a broader section 34. There is a lobe 36 which is further removed from the section 32 than is the lobe 38. There are apertures 40 and 42 in the respective lobes. Likewise, there are slotted apertures 44 and 46 in the buoyant element 12, so that the band or belt 14 can be threaded through the buoyant element 12 and thereby be affixed to the band or belt 14.

At the ends 48 and 50 of the band or belt 14 respectively, there is a coupling mechanism 52 and 54 which can interact to permit locking of the band or belt about the body. The band or belt length 14 can be varied by adjustment through a loop in a conventional manner so that the buoyant device can fit around the waist as required.

Figure 2:
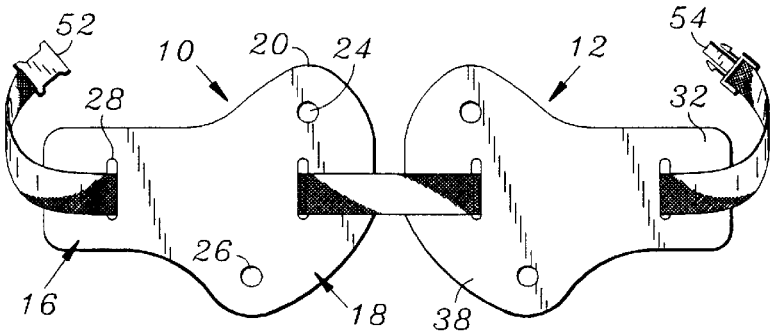
FIG. 2 is a perspective view showing two buoyant elements attached to a band or belt in a different relationship.

As illustrated in FIG. 2, the arrangement is shown where the buoyant elements are oppositely located to that shown in FIG. 1. In this fashion, if the buoyant device is worn about the body with the greatest buoyancy at the central portion, the relationship of buoyancy on the body 56 is different.

Figure 3:
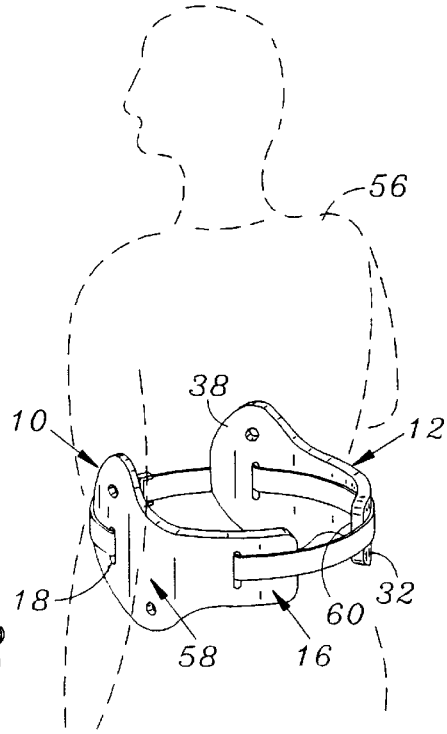
FIG. 3 is a perspective view showing the buoyant elements about a user, when the buoyant elements are in relationship to the band or belt as shown in FIG. 1.

As indicated in FIG. 3, the respective buoyancy elements 10 is located adjacent to the side 58 of the waist of the user 56, and the buoyant element 12 is located adjacent to the side 60 of the user 56. In other situations, the buoyant elements may be positioned closer together towards the back portion of the user 56. In yet further situations, the buoyant elements may be positioned about the front or stomach portion.

As indicated, the arrangement of the buoyant elements can be designed to accommodate each particular user 56. In different situations, elements 10 and 12 can be arranged differently. One element can have the broader lobes inwardly directed and the narrower portion outwardly directed, while the other buoyant element is oppositely located on the band or belt.

In yet different situations, the two or more buoyant elements can be arranged such that the lobe 22 instead of pointing downwardly and the lobe 20 pointing upwardly can be reversed. Multiple combinations are possible.

Figure 10:
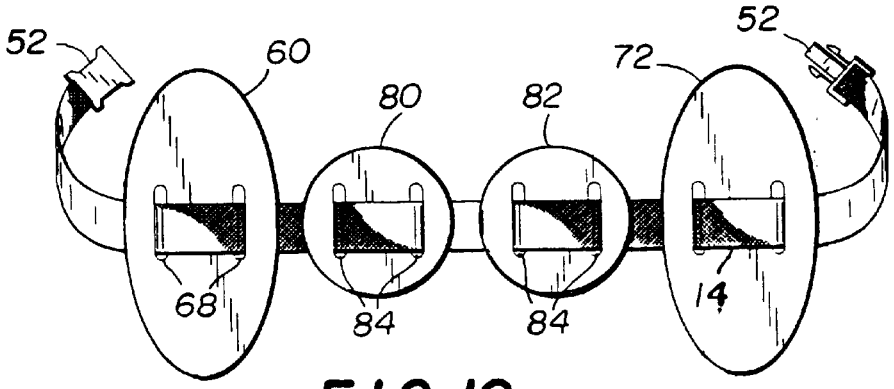
FIG. 10 is an embodiment of the invention where there are four buoyant elements and where there are respectively two elliptical and two circular in cross sectional elements.

Many other forms of the invention exist each differing from the other, in matters of detail only. For instance, there can be situations where instead of two buoyant elements, there can be three or four or more different elements arranged on the belt. Different cross-sections and thicknesses of buoyant material can be provided, and the buoyant elements can be found with a curved profile to hug the body contours, or be relatively straight flat surface profile. Likewise, some of the shapes of the buoyant elements can be regular as opposed to the irregular shape which is illustrated in the accompanying figures. In FIG. 10 elements are shown which are respectively circular, and oval or elliptical in cross-section.

Figure 4:
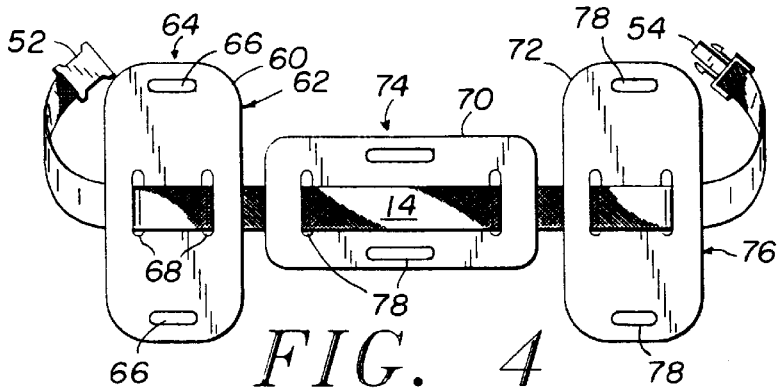
FIG. 4 is an alternate view of three buoyant elements attached by a band or belt.

In the FIG. 4 embodiment there are three buoyant elements attached by a band or belt. Two of the elements are relatively elongated and located vertically, and a central element is elongated and located transversely. As illustrated in FIG. 4 the buoyant element 60 is located so that the length 62 is transversely related to the band or belt 14. The width 64 is located so that it is substantially parallel to the direction of the belt or band 14. The buoyant element 60 includes apertures 66 at the far ends of the length and apertures 68 oppositely located across the width when the band or belt is passed through the apertures 68. As indicated the element 60 is located in the transverse relationship where its length is transverse to the direction of the band or belt. When the band or belt 14 is located through the aperture 66, the belt would be located with the length 62 substantially parallel to the length of the band or belt. The arrangement also shows a buoyant element 70 located between the buoyant element 60 and further buoyant element 72 on the opposite side of the buoyant element 70. The buoyant element 60 is located transversely with its length 74 substantially parallel to the band or belt 14. The buoyant element 72 is located transversely with its length 76 substantially transverse to the band or belt 14. Each of the buoyant elements 70 and 72 has different apertures generally indicated by numeral 78 which can be used to position them on the band or belt in different orientations on the band or belt 14 in the requisite desired position. This makes the elements 60, 70 and 72 adaptable and adjustable in their positions relative to the band or belt. Similar configurations with multiple apertures can be provided to the elements which are illustrated in FIG. 5.

Figure 5:
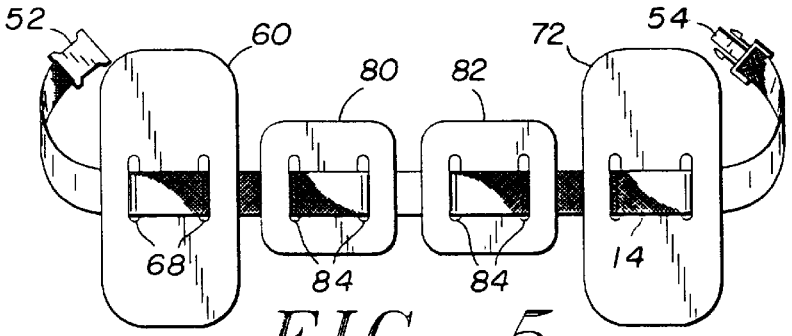
FIG. 5 is an alternate view showing four buoyant elements attached by a band or belt.

In the FIG. 5 embodiment there are four buoyant elements attached by a band or belt. There are two smaller elements located next to each other and two elongated elements vertically located outside of these smaller elements. The elongated elements 60 and 72 are illustrated in the transverse position in FIG. 5 in a manner similar to that illustrated in FIG. 4. Between these elements however, there are two substantially square type elements 80 and 82 respectively placed in adjacency between the elongated elements 60 and 72. The four elements in FIG. 5 adopt a substantially H-shaped configuration. This is similar to the configuration illustrated in FIG. 4. As indicated the elements 80 and 82 can be provided with apertures transversely related to the aperture 84 so that the they can be configured with the belt in a different manner. Likewise elements 60 and 72 can be provided with apertures 66 and 78 as illustrated in FIG. 4.

Figure 6:
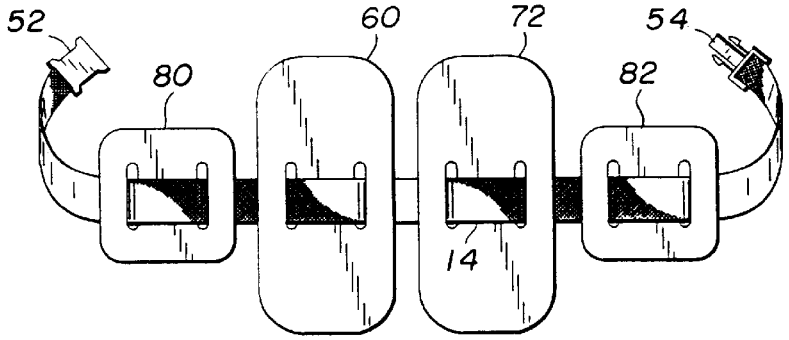
FIG. 6 is an alternate view showing the four buoyant elements with attached band or belt.

In the FIG. 6 embodiment there are four buoyant elements with attached band or belt. There are two elongated elements 60 and 72 located vertically next to each other and two smaller elements 80 and 82 located outside of these elongated elements. In FIG. 6 there is shown a relationship of two substantially square buoyant elements 80 and 82 placed outside the elongated buoyant elements 60 and 72. The buoyant elements 60 and 72 are substantially adjacent to each other. In this manner the combination of buoyant elements forms a substantially T-shaped or cross-shaped configuration.

Figure 7:
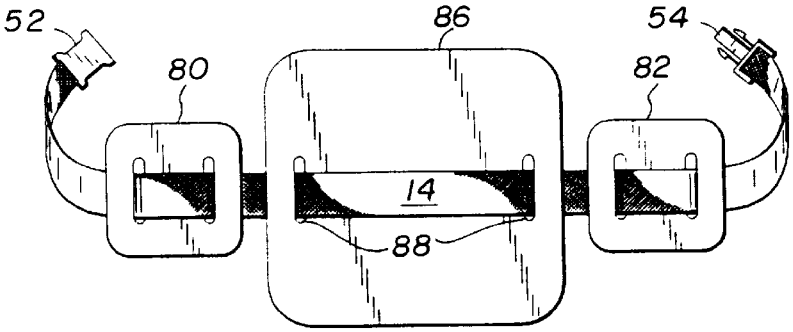
FIG. 7 is an alternate view showing three buoyant elements with attached band or belt.

In the FIG. 7 embodiment there are three buoyant elements with attached band or belt. A central large element is located in the center, and there are two smaller elements to either side of the large element. In this arrangement there are substantially square shaped elements 80 and 82 to either side of a larger square shaped element 86 which has apertures 88 on opposite ends through which the belt 14 can be threaded.

Figure 8:
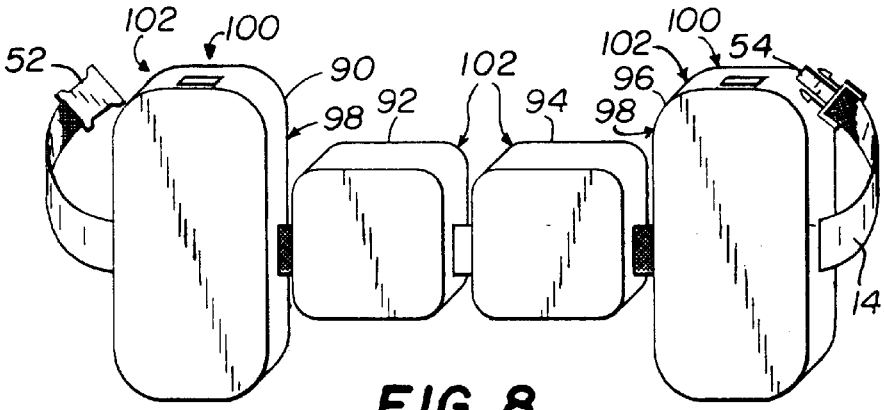
FIG. 8 is an embodiment of the invention where there are 4 buoyant elements and the band or belt passes through slots traversing the buoyant elements.

As illustrated in FIG. 8 there is an elongated buoyant element 90 placed adjacent to a substantially square buoyant element 92 which in turn is placed substantially adjacent to a square buoyant element 94 which in turn is placed next to a substantially elongated element 96. The buoyant elements 90 and 96 define lengths 98 respectively and widths 100 respectively. Each of the elements 90, 92, 94 and 96 each define a depth 102. The square elements 92 and 94 have a length and width which is substantially equal thereby making these elements square.

Figure 9:
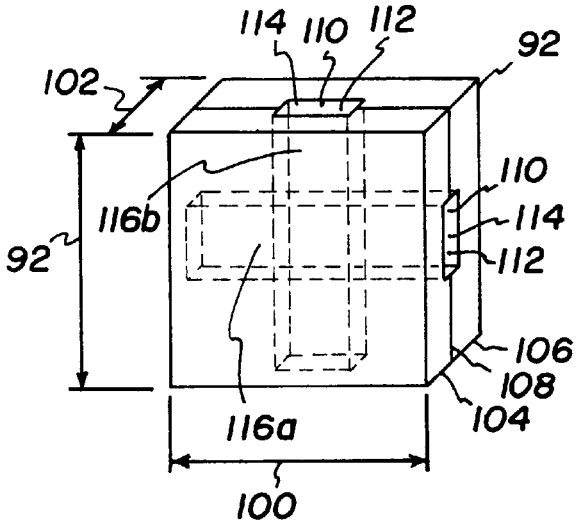
FIG. 9 is an embodiment illustrating a buoyant element composed of two fused or laminated components with slots or passageways in different directions through the element.

FIG. 9 illustrates further aspects of the invention with respect to an exemplified square element 92. Each of the buoyant elements of FIG. 8 are made up of two components 104 and 106 which are glued or bonded together along line 108. At least one of these components 104 and 106 has a partial track portion 110 and 112 which meet together to form an aperture 114. The aperture 114 defines a transverse passageway 116*a* and 116*b* respectively. These passageways are transversely related to each other so that a band or belt 14 can be passed transversely through the respective passageway 116*a* and 116*b* as selected by a user. The components 90 and 96 in FIG. 8 can have a similar configuration with transverse passageways 116*a* and 116*b* directed through them. In this manner the band or belt 14 passes through each of these components as desired. The slots can be made within laminated or non-laminated buoyant elements. They can be in only one of the laminated components of the element. In some cases there may be no formed pre formed slots, and instead the apertures can be made by forcing a sharp blade through the element.

As required, components 104 and 106 can be made of the same or different colors for instance, blue and green. In this manner different effects can be achieved with the device. This can be useful in facilitating coding to assist on how to pass a band or belt 14 through requisite apertures 114, particularly where the longitudinal elements 90 and 96 are concerned, and to add color variety to match user's clothing or preference.

The invention is determined solely in terms of the following claims. As used therein the term "band" is intended to cover either a band or a belt.

What is claimed is:

1. A flotation device comprising:

buoyant elements to be worn around the mid-section of a human;

a band for surrounding the mid-section of the human;

means for securing the buoyant elements to the band in selectively different positions whereby the buoyancy effect on the human is variable according to the position of the elements on the band;

the buoyant elements including apertures, and the band being threaded through the apertures to affix the buoyant elements with the band; and wherein there are at least four buoyant elements on the belt, at least two elements being substantially elongated and two elements being substantially equal, the elongated elements being relatively larger than the substantially equal elements, and wherein in a first position, elongated elements are placed in adjacency and the equal elements are placed outside of the elongated elements such that a substantial cross-shaped configuration is formed, and wherein in a different configuration the equal elements are placed in adjacency and the elongated elements are placed outside the adjacent equal elements such that a substantially H-shaped configuration is formed.

2. A flotation device comprising:

at least two buoyant elements to be worn around the mid-section of a human;

a band for surrounding the mid-section of the human;

means for securing the buoyant elements to the band in selectively different positions whereby the buoyancy effect on the human is variable according to the position of the elements on the band;

the buoyant elements including apertures, and the band being threaded through the apertures to affix the buoyancy elements with the band; and the buoyant elements including at least two components affixed together, and wherein at least one of the components includes at least a portion of a passageway through the component such that when the components are affixed together, a passageway is provided for passage of the band through the buoyant elements.

3. A device as claimed in claim 2 wherein there are at least four elements on the belt, at least two elements being substantially elongated and two elements being substantially equal, the elongated elements being relatively larger than the equal elements, and wherein in any first position elongated elements are placed in adjacency and the equal elements are placed outside of the elongated elements such that a substantial cross-shaped configuration is formed, and where in a different configuration the equal elements are placed in adjacency and the elongated elements are placed outside the adjacent equal elements such that a substantially H-shaped configuration is formed.

4. A flotation device comprising:

buoyant elements to be worn around the mid-section of a human;

a band for surrounding the mid-section of the human;

means for securing the buoyant elements to the band in selectively different positions whereby the buoyancy effect on the human is variable according to the position of the elements on the band;

the buoyant elements including apertures, and the band being threaded through the apertures to affix the buoyancy elements with the band; and wherein there are at least four elements on the band, at least two elements being substantially larger than the other elements, and wherein in a first position larger elements are placed in adjacency and the smaller elements are placed outside of the larger elements, and wherein in a different configuration the larger elements are placed outside at least one of the smaller elements.

* * * * *